US006607043B1

(12) United States Patent
Sunde et al.

(10) Patent No.: US 6,607,043 B1
(45) Date of Patent: Aug. 19, 2003

(54) DOWN HOLE MOTORS AND METHODS FOR THEIR OPERATION

(75) Inventors: Egil Sunde, Sandnes (NO); Per Olaf Haughom, Tonstad (NO)

(73) Assignee: Den Norske Stats Oljeselskap A.S., Stavanger (NO)

( * ) Notice: Subject to any disclaimer, the term of this patent is extended or adjusted under 35 U.S.C. 154(b) by 0 days.

(21) Appl. No.: 09/830,281

(22) PCT Filed: Oct. 25, 1999

(86) PCT No.: PCT/GB99/03511

§ 371 (c)(1),
(2), (4) Date: Jul. 2, 2001

(87) PCT Pub. No.: WO00/24997

PCT Pub. Date: May 4, 2000

(30) Foreign Application Priority Data

Oct. 26, 1998 (GB) ..... 9823411

(51) Int. Cl.[7] ..... E21B 4/02; E21B 7/00

(52) U.S. Cl. ..... 175/57; 175/26; 175/38; 175/107; 137/115.05

(58) Field of Search ..... 175/107, 57, 26, 175/38, 101, 106; 137/115.05; 91/45; 415/903

(56) References Cited

U.S. PATENT DOCUMENTS 3,952,816 A * 4/1976 Takano et al. ..... 175/103
3,964,558 A 6/1976 Fogle
3,967,680 A * 7/1976 Jeter ..... 166/325
4,275,795 A * 6/1981 Beimgraben et al. ..... 166/318
4,276,944 A 7/1981 Geczy
4,705,117 A 11/1987 Warren
4,768,598 A 9/1988 Reinhardt
5,165,492 A * 11/1992 Beasley ..... 166/330
5,443,128 A * 8/1995 Amaudric du Chaffaut ... 175/25
6,176,327 B1 * 1/2001 Hearn ..... 175/38
6,334,458 B1 * 1/2002 Amaduzzi ..... 137/115.05
6,419,014 B1 * 7/2002 Meek et al. ..... 166/255.2

FOREIGN PATENT DOCUMENTS

FR 2541364 8/1984

OTHER PUBLICATIONS

Search Report—PCT/GB99/03511.
Preliminary Examination Report—PCT/GB99/03511.

* cited by examiner

*Primary Examiner*—William Neuder
*Assistant Examiner*—Shane Bomar
(74) *Attorney, Agent, or Firm*—Patterson, Thuente, Skaar & Christensen, P.A.

(57) ABSTRACT

A down hole motor assembly includes a hydraulic drive portion, a drill bit operatively connected to the drive portion and a disengage mechanism (11) arranged to disengage drive to the drill bit. The disengage mechanism (11) is arranged to be actuated by supplying drilling fluid to the drive portion at a flow rate which is greater than the flow rate at which fluid is supplied to run the drive portion during normal drilling. The disengage mechanism is arranged to be re-set so that drive is reconnected to the drill bit when the fluid supply to the drive portion is shut off.

26 Claims, 5 Drawing Sheets

54
41
27
15
16
12
38
35
14
44
31
29
19
32
23
25
26

27
41
15
16
12
35
14
29
19
32
23
25
26

43
47
44
48
45
46
42
27
54
28
31
49
51

13
27
28
29
15
19
16
32
38
23
35
25
12

63
62
61

13
27
28
29
15
19
16
32
38
23
35
25
12
71
63
62
61

63
61
64
71
65
12
68
66
67
72
69

DOWN HOLE MOTORS AND METHODS FOR THEIR OPERATION

FIELD OF THE INVENTION

The present invention is concerned with down hole motors and methods of their operation.

BACKGROUND OF THE INVENTION

Down hole motors are commonly used in drilling applications, particularly in long reach drilling where the drill string length is considerable. In oil well drilling applications, the drill string length may exceed 10,000 m. However, problems exist when the wells are not vertical.

In general, down hole motors are hydraulically driven by the drilling mud/fluid.

There are several instances when it may be desirable to circulate the drilling fluid while drilling is not actually taking place. These include, amongst things, withdrawal of the bit/motor and flushing out debris. If during these operations, the drill bit turns, it will dig in to the low side of the hole, resulting in a hole which is oval shaped. This is highly undesirable since it can lead to side tracking and the failure of completion devices.

A solution to these difficulties is to provide a bypass valve for the drilling liquid so that it can circulate without turning the motor. Various proposals have been made, in particular, systems where a motor bypass valve is activated in response to pressure pulses. Unfortunately, the pressure fluctuates constantly during normal drilling and so in practice, these systems have not met with success.

SUMMARY OF THE INVENTION

It is therefore an object of the present invention to provide a system for a down hole motor which can be activated with greater certainty by the drill operator, to enable the drilling fluid to circulate through the bit without turning the drill bit.

According to one aspect of the invention, there is provided a method of operating a down hole motor assembly which comprises a hydraulic drive portion, a drill bit operatively connected to the drive portion, and a disengage mechanism arranged to disengage drive to the drill bit, the method comprising: supplying fluid to the drive portion at a first fluid flow rate selected to drive the drive portion and consequently the drill bit; supplying fluid at a second flow rate which is greater than the first flow rate, thereby actuating the disengage mechanism so that the drill bit ceases to be rotated; and supplying fluid at a third flow rate which is significantly lower than the first flow rate, thereby resetting the disengage mechanism so that drive is reconnected to the drill bit.

Generally, a down hole motor is arranged to run at an optimum speed and drilling fluid is pumped to the motor at the appropriate flow rate to achieve that speed. If the motor is run at a higher speed for any length of time, the motor will suffer damage. However, the motor can be run at a high speed for a short period without significant damage. In the present invention, an increased flow rate is used, but only for a short period. The advantage is that it is very much easier for an operative to control drilling fluid flow rate than pressure and, mechanisms which are sensitive to flow rate changes are more reliable than mechanisms sensitive to pressure changes.

Typically, during normal drilling, a drilling fluid flow rate might be 2000 l/min. This would correspond to the first flow rate. The second flow rate used, might then be about 2500 l/min. Preferably, the second flow rate is greater than the first flow rate by 10% to 50%, more preferably from 15% to 30%, for example, about 20%. Preferably the third flow rate is at most 10% of the first flow rate, more preferably at most 5% and is most preferably zero.

Preferably, the fluid at the second flow rate, moves a disengage component axially, thereby actuating the disengage mechanism. Preferably, the fluid is passed through a nozzle which, at the second flow rate moves axially, thereby causing the disengage component to move. Preferably, the fluid drives a centrifugally operated actuating component at the second flow rate, in order to release the disengage mechanism for actuation. Alternatively, the disengage mechanism is actuated by means of a closed hydraulic system which is itself responsive to the fluid flow rate.

Preferably, the stop of actuating the disengage mechanism comprises directing the fluid along a bypass path which bypasses the drive portion. Alternatively, the step of actuating the disengage mechanism comprises disengaging a gear connection between the drive portion and the drill bit. Preferably, the step of re-setting the disengage mechanism comprises moving back the disengage component to its former position.

According to another aspect of the invention, there is provided a down hole motor assembly which comprises an hydraulic drive portion, a drill bit operatively connected to the drive portion and a disengage mechanism arranged to disengage drive to the drill bit; the disengage mechanism being arranged to be actuated by supplying fluid to the drive portion at a second flow rate which is greater than a first flow rate at which fluid is supplied to run the drive portion during normal drilling; the disengage mechanism being arranged to be re-set so that drive is reconnected to the drill bit when fluid is supplied to the drive portion at a third flow rate which is significantly lower than the first flow rate.

Preferably, the assembly includes a disengage component which is axially movable to actuate the disengage mechanism and preferably, a nozzle operatively connected to the disengage component, through which the fluid is arranged to flow. There is preferably also a centrifugally operated actuating component arranged to release the disengage mechanism for actuation when the actuating component is driven by the fluid at the second flow rate. In a preferred embodiment, the actuating component comprises a series of fingers pivotally connected to a housing which is rotatable by the fluid flow. The actuating component may be driven by the drive portion or by an independent drive mechanism operable by the fluid flow.

FIG. 2*c* is an enlarged view of the bypass actuator mechanism;

FIGS. 3*a* and 3*b* are similar to FIGS. 1*a* and 1*b*, but show a third embodiment;

FIG. 3*c* is an enlarged view of the actuator mechanism;

FIGS. 4*a* and 4*b* are similar to FIGS. 1*a* and 1*b*, but show a fourth embodiment;

FIG. 4*c* is a section on line A—A in FIG. 4*a;*

FIG. 4*d* is a section on line B—B in FIG. 4*a;*

FIGS. 5*a* and 5*b* are similar to FIGS. 1*a* and 1*b* but show a fifth embodiment; and FIG. 5*c* is a section on line A—A in FIG. 5*b.*

Preferably, the disengage mechanism is a fluid bypass valve operated by the disengage component which allows the fluid to bypass the drive portion when the fluid is supplied at the second flow rate. Alternatively, the disengage mechanism is a clutch arrangement operated by the disengage component to disengage the drill bit from the drive portion when the fluid is supplied at the second flow rate. Conveniently, the clutch arrangement is located between the drive portion and the drill bit.

Preferably, the assembly includes means for returning the disengage component to a former position to reset the disengage mechanism, for example, a spring. The assembly may also include a locking mechanism for locking the disengage mechanism in its actuated configuration. Preferably, the locking mechanism comprises a pin in the disengage component which is arranged to engage a detent in a fixed part of the assembly. Preferably, the pin is arranged to be disengaged when the fluid flows at the third flow rate.

BRIEF DESCRIPTION OF THE DRAWINGS

The invention may be carried into practice in various ways and some embodiments will now be described by way of example with reference to the accompanying drawings, in which.

DETAILED DESCRIPTION OF THE DRAWINGS

Figure 1A:
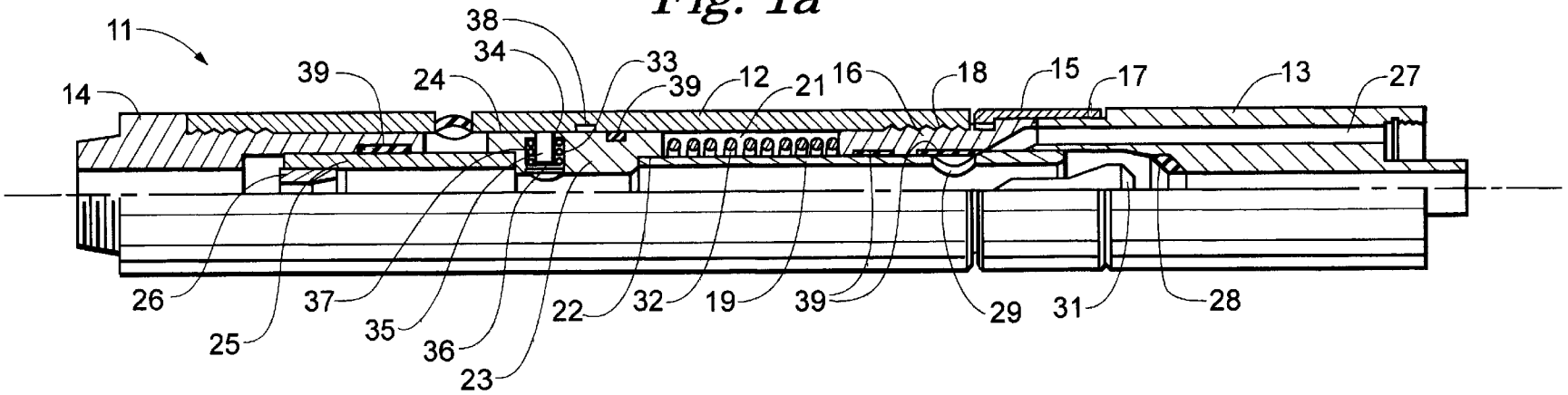
FIG. 1*a* is a longitudinal section through a bypass mechanism in accordance with a first embodiment to the invention, showing the mechanism in the drive mode.
Figure 1B:
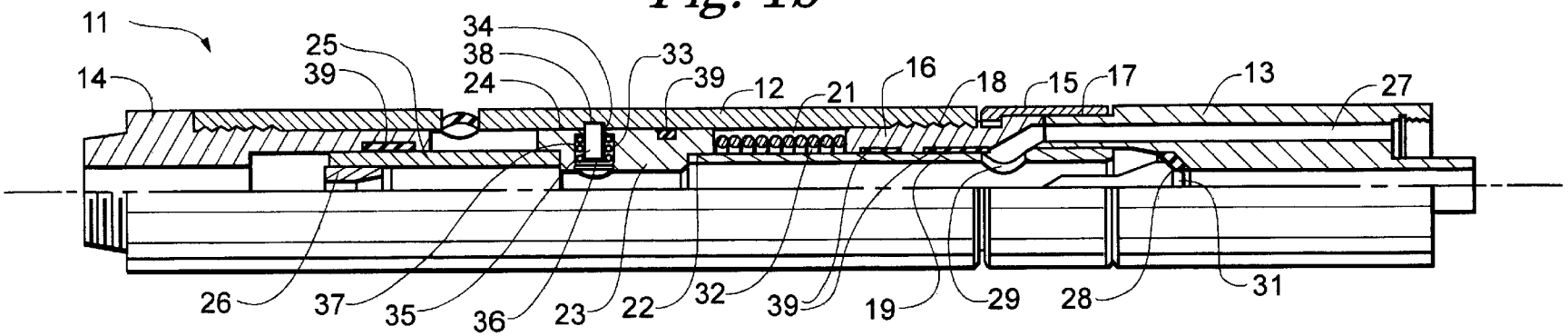
FIG. 1*b* is a view similar to FIG. 1*a*, showing the mechanism in the bypass mode.

Referring to FIGS. 1*a* and 1*b*, the device 11 is a bypass mechanism which would be located in the drill string immediately behind the motor (not shown), or to the left of the motor as shown in the drawings.

The device comprises an outer casing 12, a motor connector ring 13 at the forward or motor end and a string connector 14 at the opposite or rear end. The motor connector 13 is connected to the casing 12 by means of a collar 15 and an internal connector ring 16, which have inter engaging shoulders. The collar 15 has a screw-thread connection 17 to the motor connector 13 while the internal connector 16 has a screw-thread connection 18 to the casing 12.

A valve member 19 is slidably located within the bore of the internal connector 16 but extends rearwards beyond the end of the internal connector 16 to define an annular chamber 21. The valve member has at its rear end a screw-thread connection 22 to a collar 23 which in turn has a screw thread connection 24 at its rear end to a sleeve 25. A nozzle 26 is screwed into the rear end of the sleeve 25. The valve member 19, collar 23, sleeve 25 and nozzle 26 form an axially slidable sub-assembly.

The motor connector 13 has a series of longitudinal bores 27 and a rearwardly facing internal shoulder 28. The valve member 19 has a series of apertures 29 and carries a stop 31. A compression spring 32 is located in the annular chamber 21, acting between the internal connector 16 and the collar 23. The collar 23 has a radial bore 33 with a through hole 34. A pin 35 extends into the hole 34 while a head 36 on the pin 35 fits in the bore 33. A light compression spring 37 surrounds the shaft of the pin 35. The casing 12 has an internal channel 38 which corresponds in width to the through hole 34.

There are fluid tight seals 39 between the valve member 19 and the internal connector 16, between the collar 23 and the casing 12, between the sleeve 25 and the string connector 14 and between the pinhead 36 and the bore 33. There is also a sealing surface on the shoulder 28.

In drilling mode, the device is configured as shown in FIG. 1*a*. Drilling fluid passes down the center of the device through the nozzle 26, the sleeve 25, the collar 23, the valve member 19 and the motor connector 13 to the motor, which is thereby driven. When it is desired to flush fluid through the device 11 without turning the drill bit (not shown) the device 11 is reconfigured to allow the fluid to bypass the motor. This is achieved by increasing the drilling fluid flow rate.

When the flow rate is increased significantly, the nozzle 26 is forced forwards. This causes the entire nozzle/sleeve/collar/valve member sub-assembly also to move forwards against the spring 32 which is therefore compressed, to the position shown in FIG. 1*b*. In this configuration, the apertures 29 line up with the bores 27, allowing the drilling fluid to escape via the bores 27, thus bypassing the motor. The motor is therefore not driven, and the drill bit does not rotate.

In the bypass mode configuration, the through hole 34 lines up with the channel 38. The fluid pressure in the device forces the pin 35 to enter the channel against the force of the light spring 37, thereby locking the sub-assembly in the position shown, for as long as it is required to continue to supply fluid without turning the bit.

When it is desired to re-set the device so that the bit can be rotated once again, the fluid flow is shut off completely. This relieves the fluid pressure within the device, allowing the light spring to withdraw the pin 35. The spring 32 then moves the nozzle/sleeve/collar/valve member sub-assembly rearwards to the position shown in FIG. 1*a*. This moves the apertures 29 out of communication with the bores 27. Drilling can then be re-commenced in the normal way.

It will be appreciated that the nozzle 26 can be changed for a nozzle of a different size. This allows for some adjustability of the fluid flow rate level necessary to establish bypass.

Figures 2A, 2B, 2C:
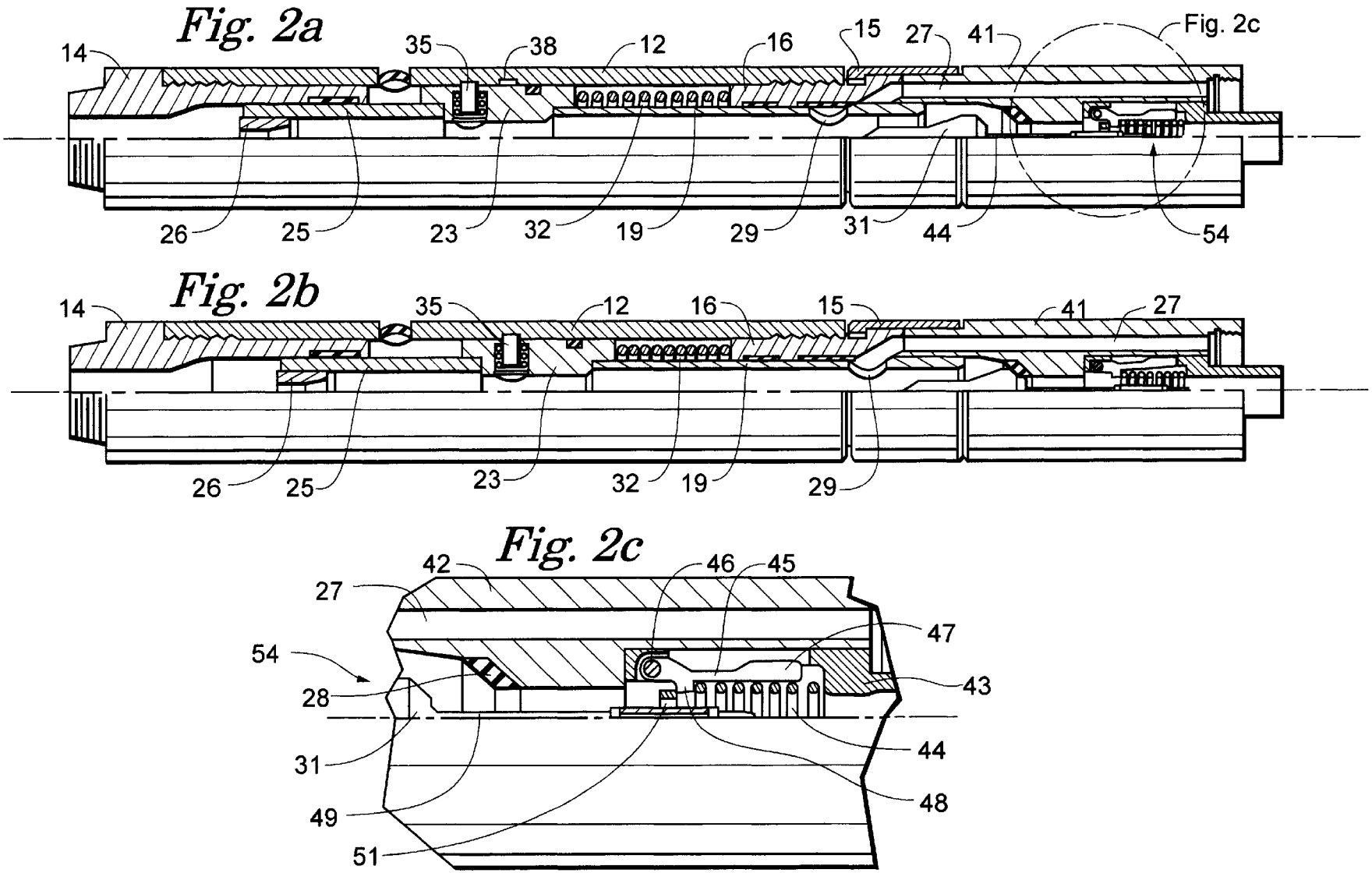
FIGS. 2*a* and 2*b* are similar to FIGS. 1*a* and 1*b*, but show a second embodiment.

The embodiment shown in FIGS. 2*a* and 2*b* is similar to the first embodiment except that an additional fluid flow-rate sensitive bypass actuator mechanism 54 is provided, located within the motor connector ring 42 as shown in FIG. 2*c*. The mechanism 54 comprises a housing 43 connected to the rotor of the motor, within which there is a spring 44 and a series (in this case, four) of fingers 45 pivotally connected to the housing 43 at a pivot point 46. Each finger 45 has a bulbous end 47 and a latch 48, and the spring 44 acts between the latch 48 and the forward part of the housing 43.

The stop 31 attached to the valve member 19 has a forward extension 49 which carries a radial flange 51 arranged to abut the latch 48. The outer diameter of the flange 51 is smaller than the internal diameter of the spring 44.

As with the previous embodiment, when it is desired to stop rotation of the bit while still flushing through the drilling fluid, the fluid flow rate is increased. Although there is a tendency for this to move the nozzle 26 (and its sub-assembly) forward, this is prevented by the engagement of the flange 51 behind the latches 48. However, as the flow rate increases, so the rotational speed of the motor also increases. This in turn increases the centrifugal force acting in the bulbous parts 47 of the fingers 45, tending to cause them to pivot outwards about the pivot points 46, against the force of the spring 44.

When a sufficient rotational speed is attained, the centrifugal force is high enough to disengage the latches 48, allowing the flange 51 to pass. The sub-assembly then moves forward and the apertures 29 communicate with the bores 27, as shown in FIG. 2*b* and as was the case in the earlier embodiment. The fluid bypasses the motor which stops rotating, and the fingers 45 return to their former positions under the action of the spring 44, but with their latches 48 behind the flange 51. Again, the pin 35 engages in the channel 38 to hold the sub-assembly in the bypass mode configuration.

It will be appreciated that this embodiment provides a more positive actuating mechanism for the bypass mode.

The re-setting procedure is similar to that in the first embodiment. The fluid flow is shut off and the pin 35 is withdrawn from the channel 38 by its spring. The spring 32 then moves the sub-assembly rearwards to the position shown in FIG. 2*a*. During this movement, the flange 51 engages the latches 48 causing them to ride up over the flange 51 and then snap back into position in front of the flange 51 as the sub-assembly is withdrawn.

Figures 3A, 3B, 3C:
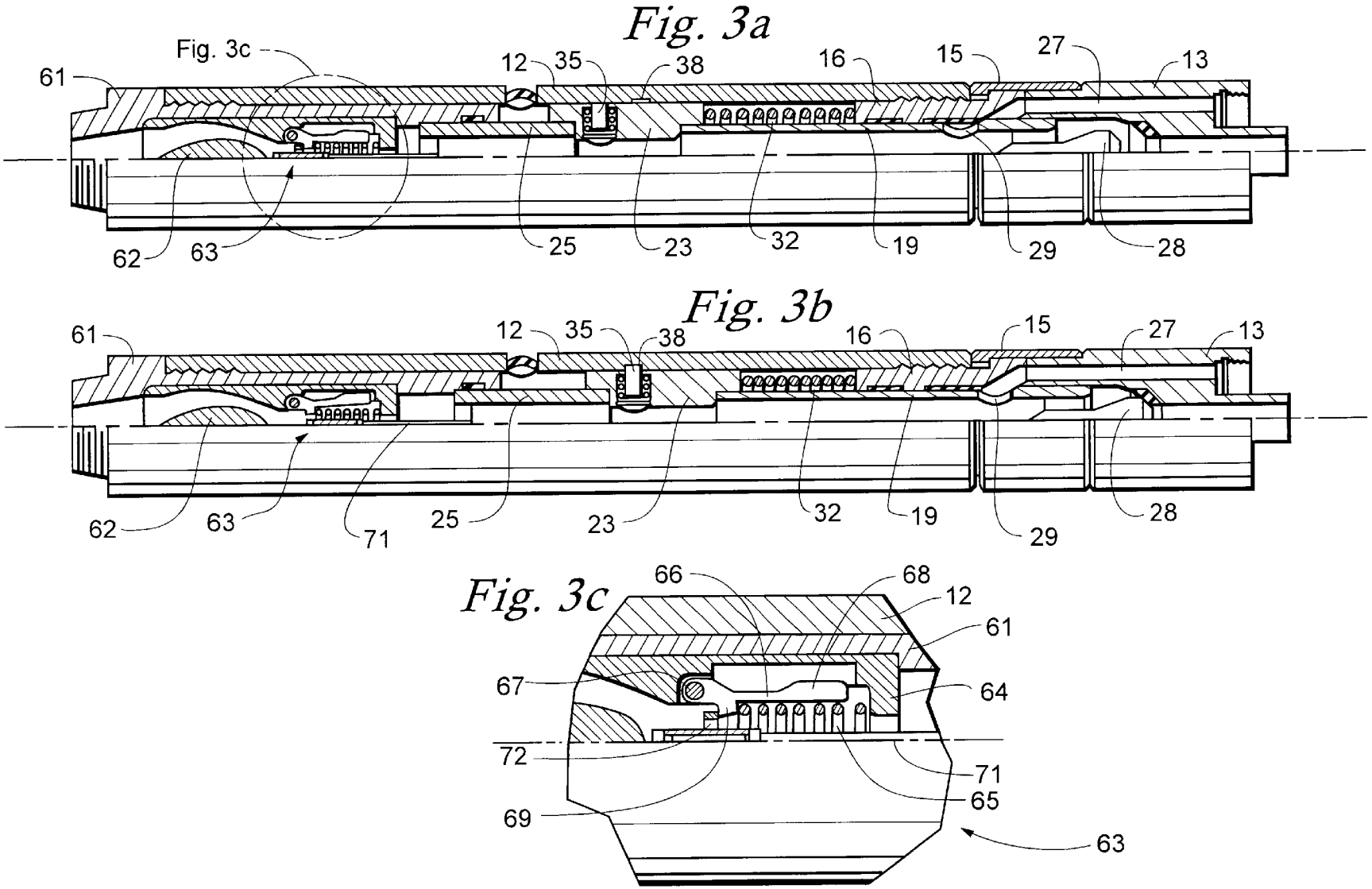
FIGS. 3*a* and 3*b* are similar to FIGS. 1*a* and 1*b*, but show a third embodiment.

The embodiment shown in FIGS. 3*a* and 3*b* is also similar to the earlier embodiments. However, in this case, the nozzle 26 is replaced by a rotor-activated actuation mechanism.

The string connector 61 is modified to receive a rotor assembly 62 and an actuator mechanism 63 shown in FIG. 3*c*, which is similar in construction to the actuator mechanism 54 in the previous embodiment. The mechanism 63 comprises a housing 64 connected to and rotatable by the rotor assembly 62. Within the housing 64 there is a spring 65 and a series of fingers 66 each pivotally connected to the housing 64 at a pivot point 67. Each finger 66 has a bulbous end 68 and a latch 69, and the spring 65 acts between the latch 69 and the forward part of housing 64.

The sleeve/collar/valve assembly 25/23/19 sub-assembly has a rearward extension 71 which carries a radial flange 72 arranged to abut the latch 69. The outer diameter of the flange 72 is smaller than the inner diameter of the spring 65.

As with the previous embodiments, when it is desired to stop rotation of the bit while still flushing through the drilling fluid, the fluid flow rate is increased. This increases the speed of rotation of the rotor assembly 62 which tends to cause the fingers 66 to pivot outwards against the spring 65. When a sufficient rotational speed is attained, the latches 69 are disengaged, allowing the flange 72 to pass. The sub-assembly moves forward under the action of the fluid, against the spring 32 and the apertures 29 communicate with the bores 27 as shown in FIG. 3*b*. The fluid bypasses the motor which stops rotating. Again, the pin 35 engages in the channel 38 to hold the sub-assembly in the bypass mode configuration.

The resetting procedure is again similar to the earlier embodiments. The fluid flow is shut off and the pin 35 is withdrawn from the channel 38 by its spring. The rotor 62 stops and the fingers 66 return to their rest position. The spring 32 then moves the sub-assembly rearwards to the position shown in FIG. 3*a*. During this movement, the flange 72 engages the latches 69 causing them to ride up over the flange 72 and then snap back into position in front of the flange 72 as the sub-assembly is withdrawn.

Figure 4A:
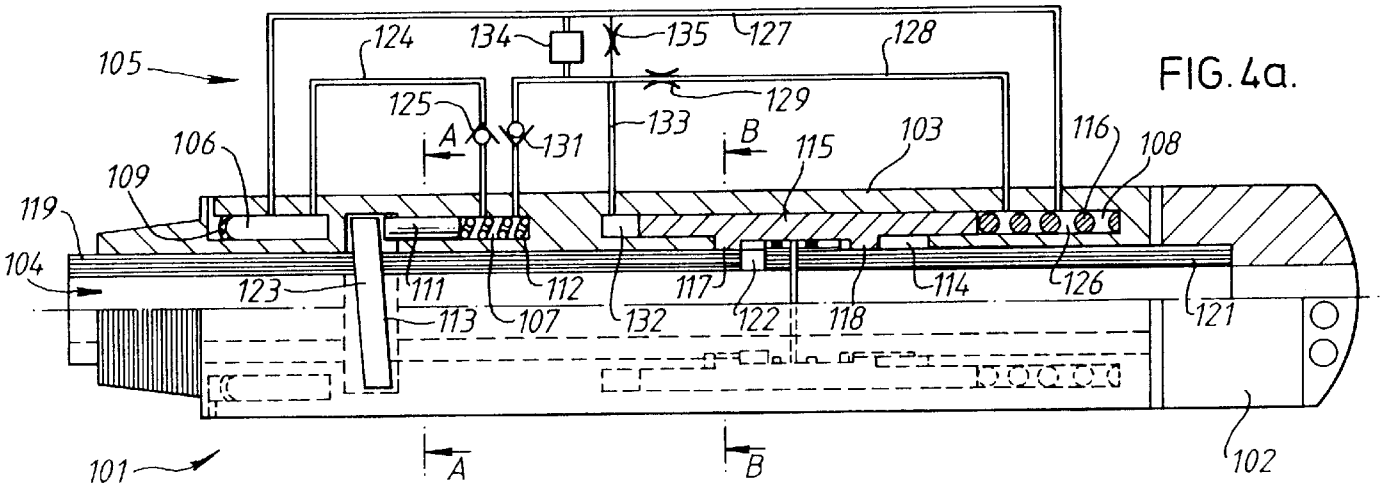
FIGS. 4*a* and 4*b* are similar to FIGS. 1*a* and 1*b*, but show a fourth embodiment.
Figure 4B:
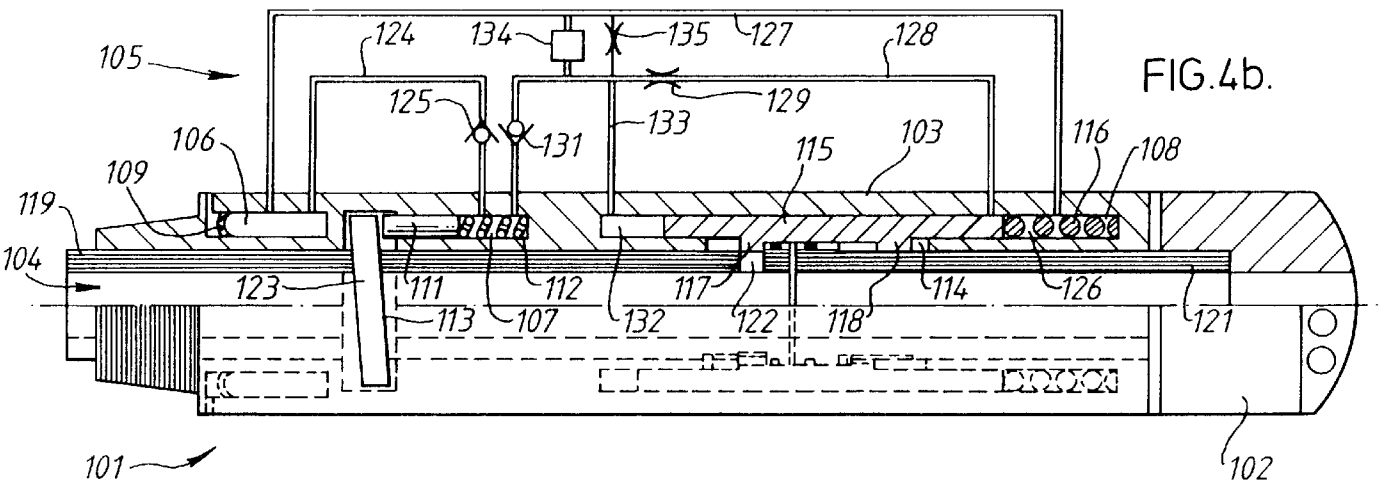
Figure 4C:
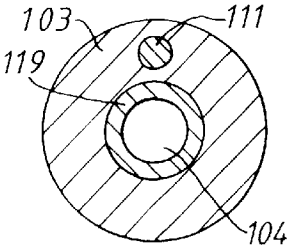
Figure 4D:
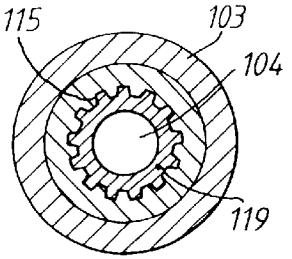

The embodiment shown in FIGS. 4*a* and 4*b* differs from the previous embodiments in that the device employs a closed hydraulic system. In the drawings, the hydraulic lines are shown schematically for ease of clarity.

The device 101 shown is located between the motor (which would be to the left in the drawings, if it were shown) and the drill bit 102, and comprises a generally cylindrical housing 103 with a central bore 104. The hydraulic system 105 comprises an annular hydraulic fluid or oil reservoir 106, an oil pumping cylinder 107 and an annular gear chamber 108, and is a closed system.

The oil reservoir is exposed to ambient pressure through a diaphragm 109. The cylinder 107 contains a piston 111 and a compression spring 112 acting between the piston and the one end of the cylinder 107. At the other end, the piston 111 protrudes into an annular channel 113.

The gear chamber 108 has a cylindrical opening 114 and contains a gear sleeve 115 and a compression spring 116. The spring 116 acts between the gear sleeve 115 and one end of the chamber 108. The gear sleeve 115 has two radially inwardly facing rings of teeth 117,118 which protrude through the opening 114 into the bore 104.

The bore 104 receives a first hollow splined drive shaft 119 which is rotated by the motor. It also receives at the other end a second hollow splined drive shaft 121 which meshes with the bit 102. The first shaft 119 has a plain portion 122 forward of the first ring of teeth 117 and a swash plate 123 which extends into the channel 113. In the normal configuration, the piston 111 engages the swash plate 123, the first ring of teeth 117 meshes with the first shaft 119 and the second ring of teeth 118 meshes with the second shaft 121.

The closed portion of the cylinder 107 is connected to the reservoir 106 via a line 124 which includes a one-way valve 125 from the reservoir 106. The reservoir is also connected to the forward portion 126 of the chamber 108 which contains the spring 116 via a line 127. The forward portion 126 is also connected to the cylinder 107 via line 128 which includes an adjustable choke valve 129 and a one-way valve 131 from the cylinder 107. The rear portion 132 of the chamber 108, which is at the opposite end of the sleeve 115, is connected to the line 128 via a line 133. Finally, the lines 127 and 128 are interconnected via a pressure relief valve 134 and an adjustable choke 135 which allows less fluid to pas than the other choke valve 129.

In use, the device 101 would normally be in the drilling mode configuration as shown in FIG. 4*a*. Drilling fluid is supplied to the motor which rotates the first shaft 119. The first shaft 119 drives the sleeve 115 which in turn drives the second shaft 121 and so the drill bit 102. At the same time, the swash plate 123 rotates and reciprocates the piston 111 against the spring 112. This causes fluid to circulate in the hydraulic system, particularly in view of the two one-way valves. Thus, the circuit of the oil is as follows: cylinder 107, valve 131, line 128, the forward portion 126, line 127, reservoir 106, line 124, valve 125 and back to cylinder 107. The pressure in the rear portion 132 is normally not sufficient to overcome the force of the spring 116 during the drilling mode.

When it is desired to stop the bit rotating while still circulating the fluid, as in the previous embodiments, the fluid flow rate is increased which drives the swash plate 123 more rapidly. The choke valve 129 limits flow to the forward portion 126 while the pressure in the rear portion 132 increases and so the sleeve 115 gradually moves forwards. At a particular flow rate, the pressure in the rear portion 132 overcomes the restricted pressure in the forward portion 126 and the spring 116 to such a degree that the sleeve 115 moves forward far enough to cover the opening to line 128.

In this configuration, as shown in FIG. 4*b*, the first gear ring 117 coincides with the plain portion 122 and so no drive is transferred to the sleeve 115 and consequently no drive is transferred to the shaft 121 and the drill bit 102. At the same time, the drilling fluid continues to circulate through the bit 102. Once this configuration has been attained, the fluid flow rate can be reduced considerably. The continuing rotation of the swash plate 123 however maintains the pressure in the rear portion 132 but no fluid pressure reaches the forward portion 126 via line 128 since line 128 is closed off.

When it is desired to reset the device so that the bit can be rotated once again, the fluid flow is shut off completely. The motor therefore stops and the swash plate 123 ceases to rotate. The oil in the closed hydraulic system 105 no longer circulates. The fluid in the rear portion 132 is allowed to bleed off very slowly via the highly restrictive choke valve 135 as the spring 116 forces the sleeve 115 rearwards. The oil which is thus displaced from the rear portion 132 of the gear chamber 108 is gradually allowed to pass to the forward portion 126 by the choke valve 135, via the lines 133 and 127.

When the sleeve 115 passes the opening to line 128, the line 128 is connected to the forward portion 126. The pressures in the rear and forward portions 126, 132 are equalized more rapidly via the less restrictive choke valve 129 and the line 128, and so the sleeve moves more rapidly rearward to the position shown in FIG. 4*a*. In this configuration, the first gear ring 117 once again meshes with the first shaft 119. Drilling can then be re-commenced.

Although not illustrated, this embodiment could incorporate the locking mechanism including the pin 35 and channel 38 etc., as shown in the first two embodiments.

Figure 5B:
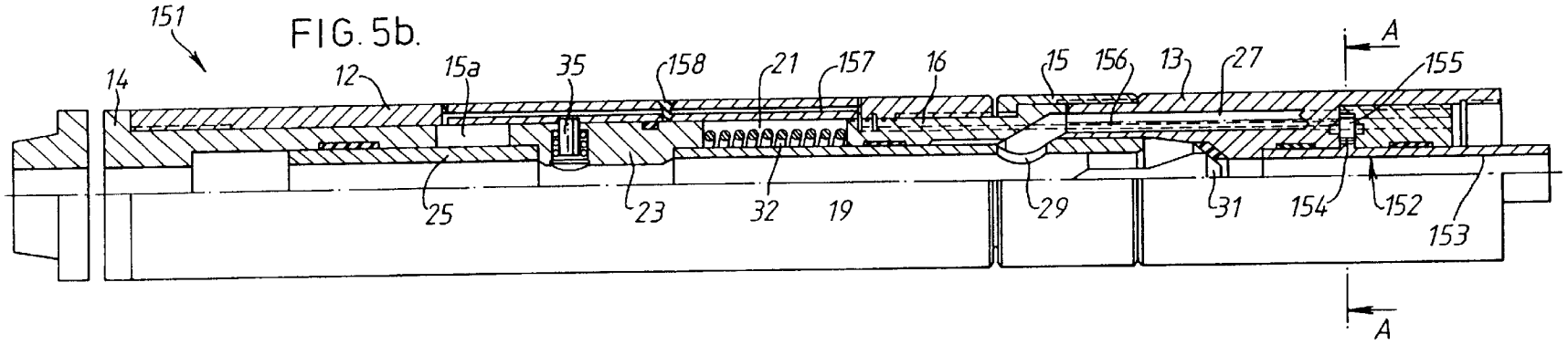
FIGS. 5*a* and 5*b* are similar to FIGS. 1*a* and 1*b* but show a fifth embodiment and FIG. 5*c* is a section on line A—A in FIG. 5*b*.
Figure 5A:
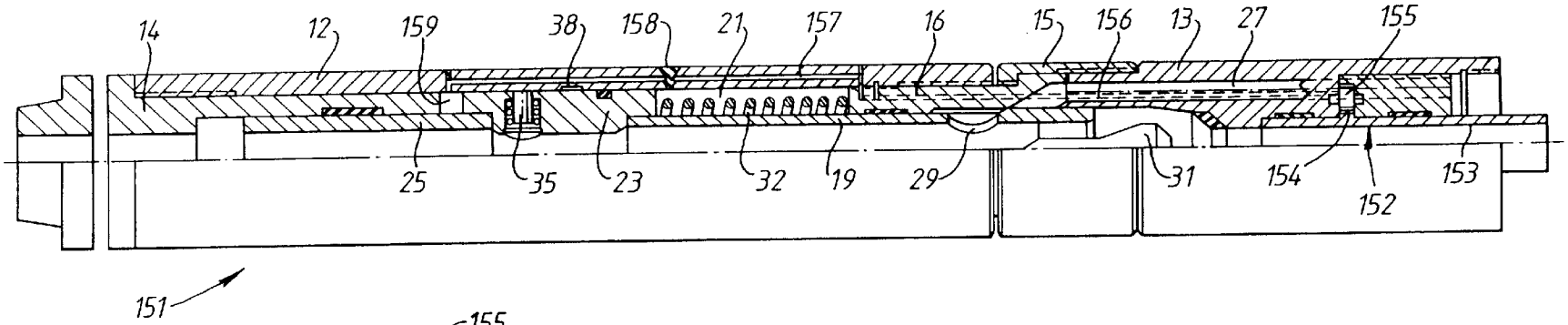
Figure 5C:
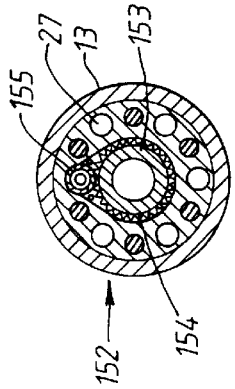

The embodiment shown in FIGS. 5*a*, 5*b* and 5*c* employs a closed hydraulic system as does the embodiment of FIGS. 4 and 4*b*, however, the device is arranged to allow drilling fluid to bypass the motor, as is the case in the earlier embodiments, rather than employing an arrangement to disconnect drive to the bit. Thus, the device 151 is similar in construction to the embodiments of FIGS. 1 to 3, but employs a closed hydraulic system to effect the bypassing function.

The closed hydraulic system comprises an oil reservoir (not shown) and a gear pump 152 driven by the motor (not shown) through a transmission tube 153. The transmission tube 153 has a ring of teeth 154 which mesh with teeth 155 on the gear pump 152. The gear pump 152 pumps oil from the reservoir along a first channel 156 formed in the internal connector ring 16 and then along a second channel 157 formed in the housing 12. The second channel 157 includes an adjustable choke valve 158 and opens into an annular chamber 159 to the rear of the collar 23. A return line (not shown) connects the first channel 156 back to the reservoir.

In drilling mode, the device is configured as shown in FIG. 5*a*. Drilling fluid is supplied to the motor which rotates the transmission tube 153 and consequently the gear pump 152. The gear pump 152 pumps oil from the reservoir, along the first channel 156 and back to the reservoir. The choke valve 158 provides a pressure drop in the second channel 157 and so the hydraulic pressure in the chamber 159 is not sufficient to overcome the effect of the spring 32 and so the sleeve/collar valve member sub-assembly does not move.

When it is desired to stop rotation of the bit while still flushing through the drilling fluid, as with all the previous embodiments, the fluid flow rate is increased. This drives the gear pump 152 more rapidly which increases the oil pressure in the first and second channels 156, 157.

At a certain level, the oil pressure is sufficient to allow oil to pass the choke valve 158 and to travel along the second channel 157 to the chamber 159. The pressure in the chamber 159 overcomes the force of the spring 32 and the sleeve/collar/valve member sub-assembly moves forwards. The apertures 29 communicate with the bores 27 as shown in FIG. 5*b* and the drilling fluid by-passes the motor. The pin 35 engages in the channel 38 to hold the subassembly in the by-pass mode configuration and the motor stops rotating.

The re-setting procedure is similar to that in the first three embodiments. The drilling fluid flow is shut off completely, which relieves the pressure within the device 151. The pin 35 is withdrawn from the channel 38 by its spring and the spring 32 moves the sub-assembly rearwards to the position shown in FIG. 5*a*. During this movement, oil from the chamber 159 returns to the reservoir via the second and first channels 157 and 156, through the choke valve 158.

What is claimed is:

1. A method of operating a down hole motor assembly which comprises a hydraulic drive portion, a drill bit operatively connected to the drive portion, and a disengage mechanism arranged to disengage drive to the drill bit, the method comprising:

supplying fluid to the drive portion at a first fluid flow rate selected to drive the drive portion and consequently the drill bit;

supplying fluid at a second flow rate which is greater than the first flow rate, thereby actuating the disengage mechanism so that the drill bit ceases to be rotated; and supplying fluid at a third flow rate which is significantly lower than the first flow rate, thereby resetting the disengage mechanism so that drive is reconnected to the drill bit.

2. The method as claimed in claim 1, in which the fluid is drilling fluid.

3. The method as claimed in claim 1 in which the third flow rate is zero.

4. The method as claimed in claim 1, in which the fluid, at the second flow rate, moves a disengage component axially, thereby actuating the disengage mechanism.

5. The method as claimed in claim 4, in which the fluid is passed through a nozzle which, at the second flow rate moves axially, thereby causing the disengage component to move.

6. The method as claimed in claim 4, in which the step of resetting the disengage mechanism comprises moving back the disengage component to its former position.

7. The method as claimed in claim 1, in which the fluid drives a centrifugally operated actuating component at the second flow rate, in order to release the disengage mechanism for actuation.

8. The method as claimed in claim 1, in which the disengage mechanism is actuated by means of a closed hydraulic system which is itself responsive to the fluid flow rate.

9. The method as claimed in claim 1, in which the step of actuating the disengage mechanism comprises directing the fluid along a bypass path which bypasses the drive portion.

10. The method as claimed in claim 1, in which the step of actuating the disengage mechanism comprises disengaging a gear connection between the drive portion and the drill bit.

11. A down hole motor assembly, comprising:

a hydraulic drive portion, a drill bit operatively connected to the drive portion, and a disengage mechanism arranged to disengage drive to the drill bit; the disengage mechanism being arranged to be actuated by supplying fluid to the drive portion at a second flow rate which is greater than a first flow rate at which fluid is supplied to run the drive portion during normal drilling; the disengage mechanism being arranged to be re-set so that drive is reconnected to the drill bit when fluid is supplied to the drive portion at a third flow rate which is significantly lower than the first flow rate.

12. The assembly as claimed in claim 11, including a disengage component which is axially movable to actuate the disengage mechanism.

13. The assembly as claimed in claim 12, including a nozzle operatively connected to the disengage component, through which the fluid is arranged to flow.

14. The assembly as claimed in claim 12, in which the disengage mechanism is a fluid bypass valve operated by the disengage component which allows the fluid to bypass the drive portion when the fluid is supplied at the second flow rate.

15. The assembly as claimed in claim 12, in which the disengage mechanism is a clutch arrangement operated by the disengage component to disengage the drill bit from the drive portion when the fluid is supplied at the second flow rate.

16. The assembly as claimed in claim 15, in which the clutch arrangement is located between the drive portion and the drill bit.

17. The assembly as claimed in claim 12, including means for returning the disengage component to a former position to reset the disengage mechanism.

18. The assembly as claimed in claim 17, in which the returning means comprises a spring.

19. The assembly as claimed in claim 12, further including a locking mechanism for locking the disengage mechanism in its actuated configuration.

20. The assembly as claimed in claim 19, which the locking mechanism comprises a pin in the disengage component which is arranged to engage a detent in a fixed part of the assembly.

21. The assembly as claimed in claim 20, in which the pin is arranged to be disengaged when the fluid flows at the third flow rate.

22. The assembly as claimed in claim 11, including a closed hydraulic system including a pump which is driven by the fluid, the hydraulic system being arranged to actuate the disengage mechanism when the pump is driven by the fluid at the second flow rate.

23. The assembly as claimed in claim 11, including a centrifugally operated actuating component arranged to release the disengage mechanism for actuation when the actuating component is driven by the fluid at the second flow rate.

24. The assembly as claimed in claim 23, in which the actuating component comprises a series of fingers pivotally connected to a housing which is rotatable by the fluid flow.

25. The assembly as claimed in claim 23, in which the actuating component is driven by the drive portion.

26. The assembly as claimed in claim 23, in which the actuating component is driven by an independent drive mechanism operable by the fluid flow.

* * * * *